US009345953B2

(12) United States Patent
Chuang

(10) Patent No.: US 9,345,953 B2
(45) Date of Patent: May 24, 2016

(54) CONFIGURABLE GAME ASSEMBLY

(71) Applicant: Mattel, Inc., El Segundo, CA (US)

(72) Inventor: Peter Chuang, Irvine, CA (US)

(73) Assignee: Mattel, Inc., El Segundo, CA (US)

( * ) Notice: Subject to any disclaimer, the term of this patent is extended or adjusted under 35 U.S.C. 154(b) by 1 day.

(21) Appl. No.: 14/245,574

(22) Filed: Apr. 4, 2014

(65) Prior Publication Data

US 2015/0283452 A1 Oct. 8, 2015

(51) Int. Cl.
*A63F 3/00* (2006.01)
*A63F 3/04* (2006.01)

(52) U.S. Cl.
CPC ..... *A63F 3/0023* (2013.01); *A63F 3/0423* (2013.01); *A63F 2003/00239* (2013.01); *A63F 2003/00946* (2013.01)

(58) Field of Classification Search
USPC ..... 273/285, 287
See application file for complete search history.

(56) References Cited

U.S. PATENT DOCUMENTS

| | | | | | |
|---|---|---|---|---|---|
| 136,200 | A | | 2/1873 | Arms | |
| 1,024,194 | A | | 4/1912 | Frank | |
| 1,317,880 | A | | 10/1919 | Lyman | |
| 1,328,711 | A | | 1/1920 | Carr | |
| 1,343,984 | A | | 6/1920 | Ramsey | |
| 1,348,262 | A | | 8/1920 | Brockway | |
| 1,436,859 | A | | 11/1922 | Bush | |
| 1,659,588 | A | * | 2/1928 | Balmforth | 273/148 A |
| 2,395,174 | A | | 2/1946 | Drueke | |
| 3,339,289 | A | * | 9/1967 | Arkin | 434/128 |
| 3,779,554 | A | | 12/1973 | Brix | |
| 3,851,885 | A | * | 12/1974 | Pepkowski et al. | 273/287 |
| 3,880,429 | A | | 4/1975 | Blumenaus | |
| 4,130,284 | A | | 12/1978 | Fuks | |
| 4,209,085 | A | | 6/1980 | Kozan | |
| 4,275,887 | A | | 6/1981 | Tateyama | |
| 4,421,312 | A | | 12/1983 | Delgado et al. | |
| 4,433,504 | A | | 2/1984 | Terui | |
| 4,513,974 | A | | 4/1985 | Lin | |
| 4,534,565 | A | * | 8/1985 | Hube | 273/241 |
| 4,811,954 | A | * | 3/1989 | Hemmann | 273/283 |
| 4,872,550 | A | | 10/1989 | Stranges | |
| 4,875,688 | A | | 10/1989 | Whaley | |
| 4,927,156 | A | | 5/1990 | Breslow et al. | |
| 5,145,185 | A | | 9/1992 | Yu et al. | |
| 5,244,212 | A | | 9/1993 | Bendit | |

(Continued)

OTHER PUBLICATIONS

Hasbro, www.hasbro.com, Scrabble Folio Edition.

*Primary Examiner* — William Pierce
(74) *Attorney, Agent, or Firm* — Sheppard, Mullin, Richter & Hampton LLP

(57) ABSTRACT

A game assembly involving the arrangement of game pieces on a game board and permitting storage and transportation of the game pieces arranged on the game board in an intermediate stage of game play. The game assembly comprises a case having a plurality of hinged case segments which are foldable from open configuration exposing a game area to a closed configuration enclosing the game area. The hinged case segments includes lateral case segments hingedly joined to opposing edges of an internal case segment. The game area is formed from lateral and internal game elements. The lateral game elements are disposed on the lateral case segments. The internal game element are hingedly connected to one of the lateral game elements and rotatably moveable between being disposed on the internal case segment and being disposed on the one of the lateral game elements.

19 Claims, 4 Drawing Sheets

(56) References Cited

U.S. PATENT DOCUMENTS

| | | | |
|---|---|---|---|
| 5,478,085 | A | 12/1995 | Canner et al. |
| 5,727,787 | A | 3/1998 | Salley |
| 5,961,149 | A | 10/1999 | Hunt |
| 6,082,545 | A | 7/2000 | Ford et al. |
| 6,196,546 | B1 | 3/2001 | Iglesias |
| 6,203,017 | B1 | 3/2001 | Schultz |
| 6,276,688 | B1 | 8/2001 | Ullerich et al. |
| 6,286,835 | B1 | 9/2001 | Quercetti |
| 6,315,293 | B1 | 11/2001 | Bush |
| 6,581,931 | B1 | 6/2003 | Doepner et al. |
| 6,634,646 | B2 | 10/2003 | Wolpert et al. |
| 6,796,561 | B2 | 9/2004 | Bedford |
| 6,871,853 | B2 | 3/2005 | Bedford |
| 7,025,352 | B2 | 4/2006 | Bedford |
| 7,040,624 | B2 | 5/2006 | Bedford |
| 7,654,531 | B2 | 2/2010 | Collins et al. |
| 7,775,798 | B2 | 8/2010 | Lucy |
| 8,353,516 | B2 | 1/2013 | Collins et al. |
| 2002/0105143 | A1 | 8/2002 | Elliott et al. |
| 2010/0118422 | A1* | 5/2010 | Holacka ..... A47G 1/02 359/854 |
| 2014/0374297 | A1* | 12/2014 | Vilkomirski ..... B25H 3/025 206/373 |

* cited by examiner

CONFIGURABLE GAME ASSEMBLY

FIELD OF THE INVENTION

This invention generally relates to game assemblies and, more particularly, to a game assembly for containing and playing a game, such as a board game, which is configurable between an open configuration exposing a game area and a closed configuration enclosing the game area for storage or travel.

BACKGROUND

There are numerous board games which require players to take turns arranging a plurality of game pieces on a game board. One example is Scrabble®, where users take turns arranging lettered tiles on a board to form interconnecting words. Such games often involve intricate arrangements of numerous pieces on a game board and are typically played over a prolonged period of time. While it is often desirable to play such games at different times or at different locations, it is often difficult to store or transport a game in progress while preserving the arrangement of the game pieces in play on the board.

It is therefore desirable to provide games which are configurable for play and for storage and transportation.

BRIEF SUMMARY

The game assemblies disclosed herein include a game case that is configurable between an open configuration exposing a game area and a closed configuration enclosing the game area. In a preferred embodiment, the game assembly involves the arrangement of a plurality of game pieces on a game board and the arrangement of the game pieces may be preserved for later play and transportation when the game case is in the closed configuration.

In one preferred embodiment, a game assembly includes a case comprising a plurality of hinged case segments having an internal surface and an external surface. The case segments are configurable between an open configuration exposing a game area on the internal surface and a closed configuration enclosing the game area. The case segments comprise lateral case segments hingedly coupled to opposing edges of a middle case segment. A game panel is pivotally movable about an axis along one of its lengthwise edges of the game panel. The game panel is disposed on top of the internal surface of the middle case segment when the case segments are in the open configuration to expose the game area. The game panel is disposed on top of the internal surface of one of the lateral case segments when the case segments are in the closed configuration.

In another preferred embodiment, the game assembly comprises a case having a plurality of hinged case segments which are foldable from an open configuration exposing a game area to a closed configuration enclosing the game area. The hinged case segments comprise lateral case segments hingedly joined to opposing edges of an internal case segment. Lateral and internal game elements form at least a portion of the game area. The lateral game elements are disposed on the lateral case segments. The internal game element is hingedly connected to one of the lateral game elements and rotatably moveable between being disposed on the internal case segment and being disposed on the one of the lateral game elements.

In a further preferred embodiment, the game assembly comprises a case having a plurality of case segments configurable between an open configuration exposing a game area and a closed configuration enclosing the game area. The case segments comprise lateral case segments and an internal case segment. The lateral case segments are pivotally coupled to opposing edges of the internal case segment along a length of the internal case segment. A plurality of recesses are disposed on at least a portion of the game area, the recesses being shaped to receive correspondingly-shaped game pieces. The game area comprises lateral and internal game panels. The lateral game panels are disposed on the lateral case segments. The internal game panel is pivotally movable between being disposed on the internal case segment and being disposed on top of one of the lateral game panels. A game panel hinge pivotally couples the internal game panel to the one of the lateral game panels. The game panel hinge is configured to space apart facing surfaces of the internal game panel and the one of the lateral game panels at a distance to permit the storage of game pieces disposed in the recesses on both the internal game panel and the one of the lateral game panels when the internal game panel is disposed on top of the one of the lateral game panels and the case segments are in the closed configuration. The lateral game panels abut or are closely spaced apart from opposing edges of the internal game panel when the internal game panel is disposed on top of the internal case segment.

Other objects, features and advantages of the described preferred embodiments will become apparent to those skilled in the art from the following detailed description. It is to be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

Illustrative embodiments of the present disclosure are described herein with reference to the accompanying drawings, in which.

Like numerals refer to like parts throughout the several views of the drawings.

DETAILED DESCRIPTION OF THE PREFERRED EMBODIMENTS

Specific, non-limiting embodiments of the present invention will now be described with reference to the drawings. It should be understood that such embodiments are by way of example only and merely illustrative of but a small number of embodiments within the scope of the present invention. Various changes and modifications obvious to one skilled in the art to which the present invention pertains are deemed to be within the spirit, scope and contemplation of the present invention as further defined in the appended claims.

The preferred embodiments of the game assemblies disclosed herein are suitable for board games and, more particularly, for board games involving a multitude of game pieces which may be stored and transported as desired. The preferred embodiments of the game assemblies are configurable between an open configuration exposing a game area and a closed configuration enclosing the game area. Where the game assembly is a game that involves the arrangement of game pieces on the game board, the game assembly is preferably configured to maintain and preserve the arrangement of the game pieces on the game board in both the open and closed configurations. Thus, it is not required to remove the game pieces from the game board prior to arranging the game assembly to the closed configuration. This advantageously permits the storage and transport of an ongoing game for continued play at a later time.

FIGS. 1-4 depict a nonexclusive illustrative preferred embodiment of a game assembly 100. Taken together, FIGS. 1-4 depict the sequence of configuring or folding the game assembly 100 from an open configuration adapted for game play to a closed configuration adapted for later play, storage or transportation. While FIGS. 1-4 depicts a multi-player board game in which each player takes turns arranging words using game tiles 10, it is understood that the game assembly 100 may be adapted to any variety of games, board games, and the like.

Figure 1:
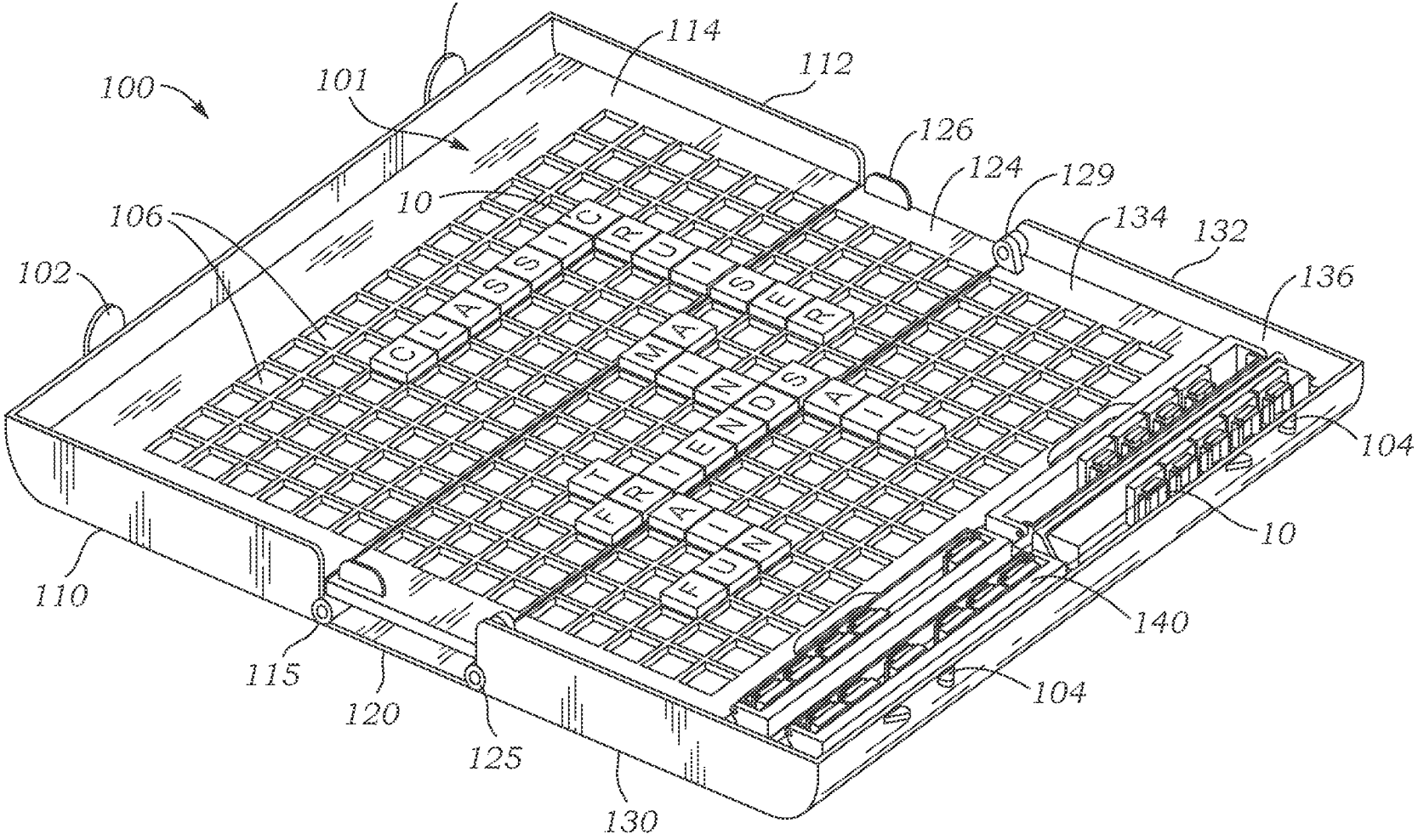
FIG. 1 is a perspective view of an embodiment of the game assembly with the game board case in an open configuration.

FIG. 1 depicts the game assembly 100 in an open configuration exposing a game area 101. The game area 101 is supported on a plurality of case segments that include lateral case segments 110, 130 coupled to opposing edges of an internal or middle case segment 120. To permit folding of the case segments from an open to a closed configuration and back to the open configuration, the lateral case segments 110, 130 are coupled to the internal case segment 120 via hinges 115, 125, respectively, along opposing edges of the internal case segment 120. A game area 101 is disposed on top of the internal surface of the lateral 110, 130 and internal 120 case segments.

The game area 101 may be provided by a plurality of separate game elements or panels 114, 124 and 134 that are disposed on or adjacent to the internal surface of corresponding case segments 110, 120 and 130. Alternatively, the game area 101 may be provided by the internal surface of the lateral case segments 120 and 130, with only the internal or middle game panel 124 being provided separately from the case segments. The internal game panel 124 is pivotally moveable about an axis A-A along one of its lengthwise edges (FIG. 2) and, where lateral game panels 114, 134 are additionally provided, the internal game panel 124 is preferably coupled to one of the lateral game panels 114, 134 via a game panel hinge 129. In both embodiments, the game area 101 is preferably a contiguous and substantially planar game surface when the game assembly 100 is in the open configuration. To that end, the game area 101 is preferably disposed on top of the hinges 115, 125 coupling the case segments.

Side walls 112, 132 may be provided along a periphery or free edge of lateral case segments 110, 130, respectively. The side walls 112, 132 extend from the lateral case segments 110, 130 at heights $h_1$, $h_2$, (see FIG. 2) to preferably provide a complete enclosure when the case segments 110, 120 and 130 are arranged in the closed configuration, as depicted in FIG. 4. The side walls 112, 132 abut one another and together maintain a distance between the lateral case segments 110, 130 at about a width (w) of the internal case segment 120. The internal case segment 120 preferably does not have side walls, as the side walls 112, 132 of the adjacent lateral segments 110, 130 abut one another to about the width (w) of the internal case segment 120 to provide the enclosure. While the side walls 112, 132 are depicted in FIGS. 1-4 as having substantially equal heights ($h_1$ and $h_2$), it is understood that they may also have differing relative heights so long as their combined heights ($h_1$+$h_2$) is equal or substantially equal to the width (w) of the internal case segment 120.

The complete enclosure provided by the side walls 112, 132 permit the game assembly 100 to securely store the game pieces 10 and other game accessories, such as the trays 140. To that end, the game assembly 100 may further comprise a storage area 136 within an internal area of one of the lateral case segments 110, 130, and separate from the game area 101. Additionally, the side walls 112, 132 may further include closure means to maintain side walls 112, 132 in abutting relation to keep the game assembly 100 in the closed configuration and to securely store the game pieces 10 and trays 140 within the game assembly. Such closure means may include one or more deflectable tabs 102 and one or more sets of cooperating keepers 104 on side walls 112, 132, respectively.

FIG. 1 depicts a game that is in the intermediate stages of game play, in which the game pieces or lettered tiles 10 are arranged on the game area 101 and secured in recesses 106 on the game area 101. In a preferred embodiment, the game pieces 10 and corresponding recesses 106 are shaped and sized to provide an engaging fit so that the game pieces 10 are not easily dislodged from the recesses 106 as the game area is oriented vertically or downwardly (see FIGS. 2-3). This permits the storage of a game in the intermediate stages of play when the game assembly 100 is in the closed configuration (FIG. 4).

Figure 2:
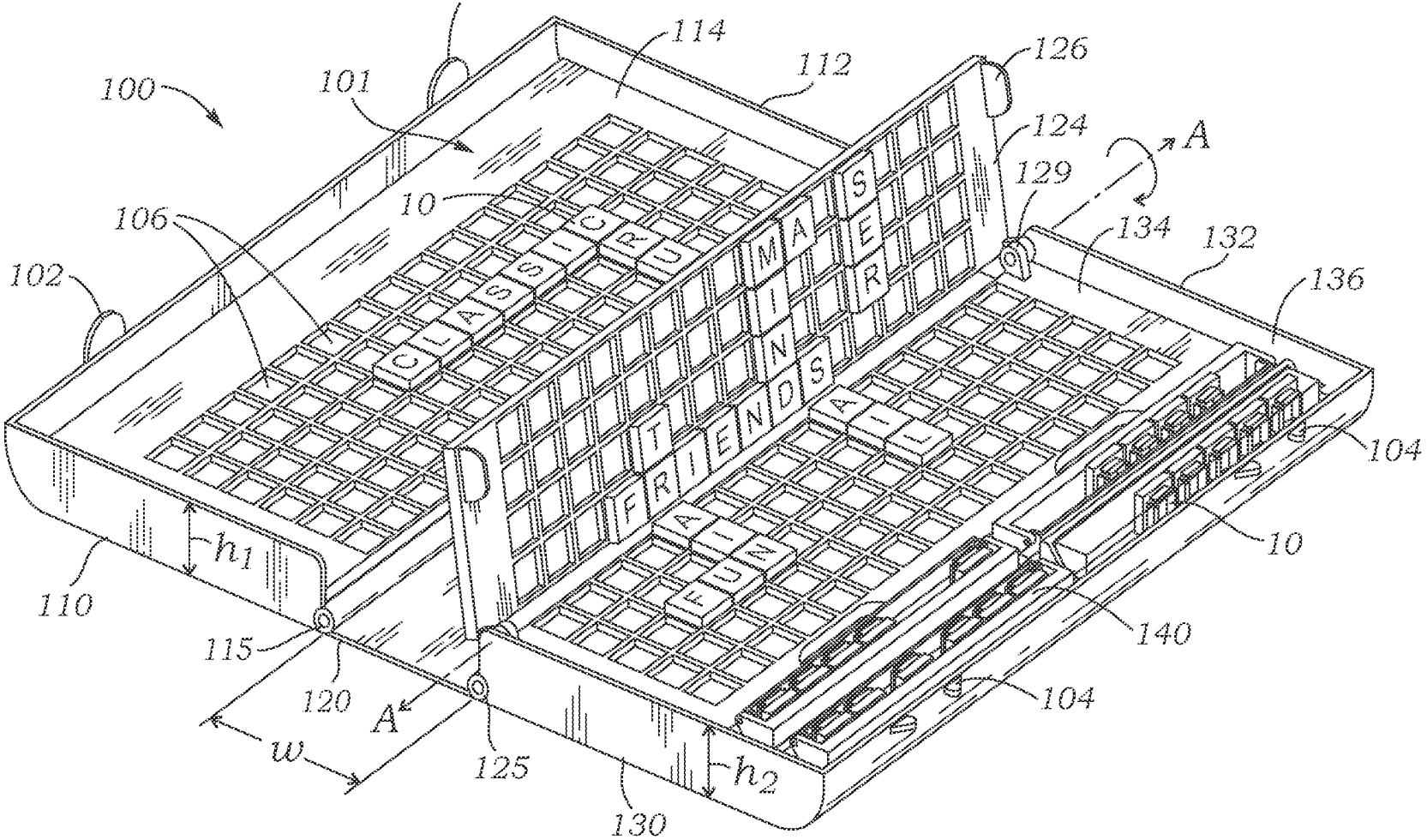
FIG. 2 is a perspective view of the game assembly, showing the folding of the internal game panel about a game panel hinge.
Figure 3:
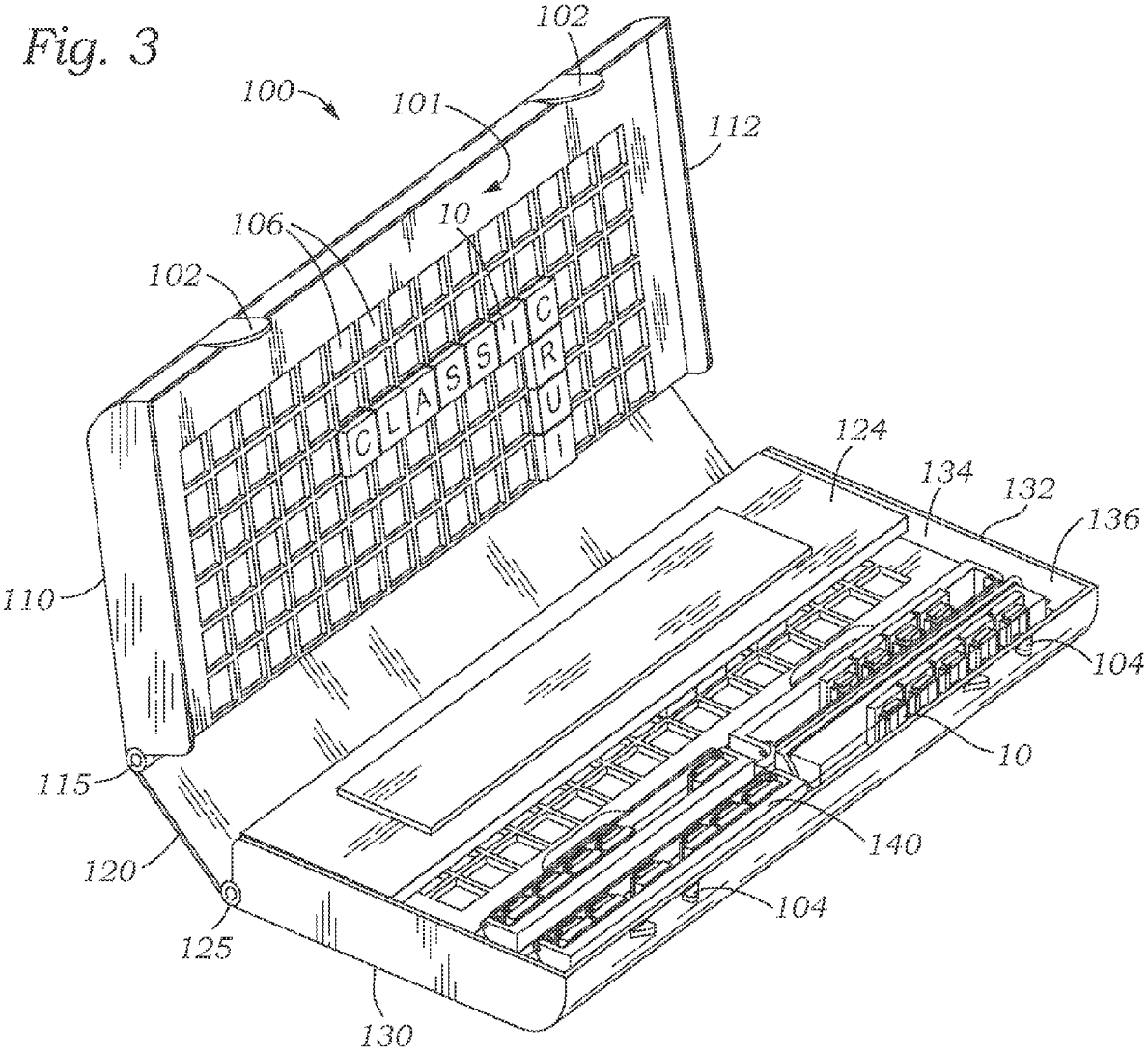
FIG. 3 is a perspective view of the game assembly, showing the folding of the lateral case segments.
Figure 4:
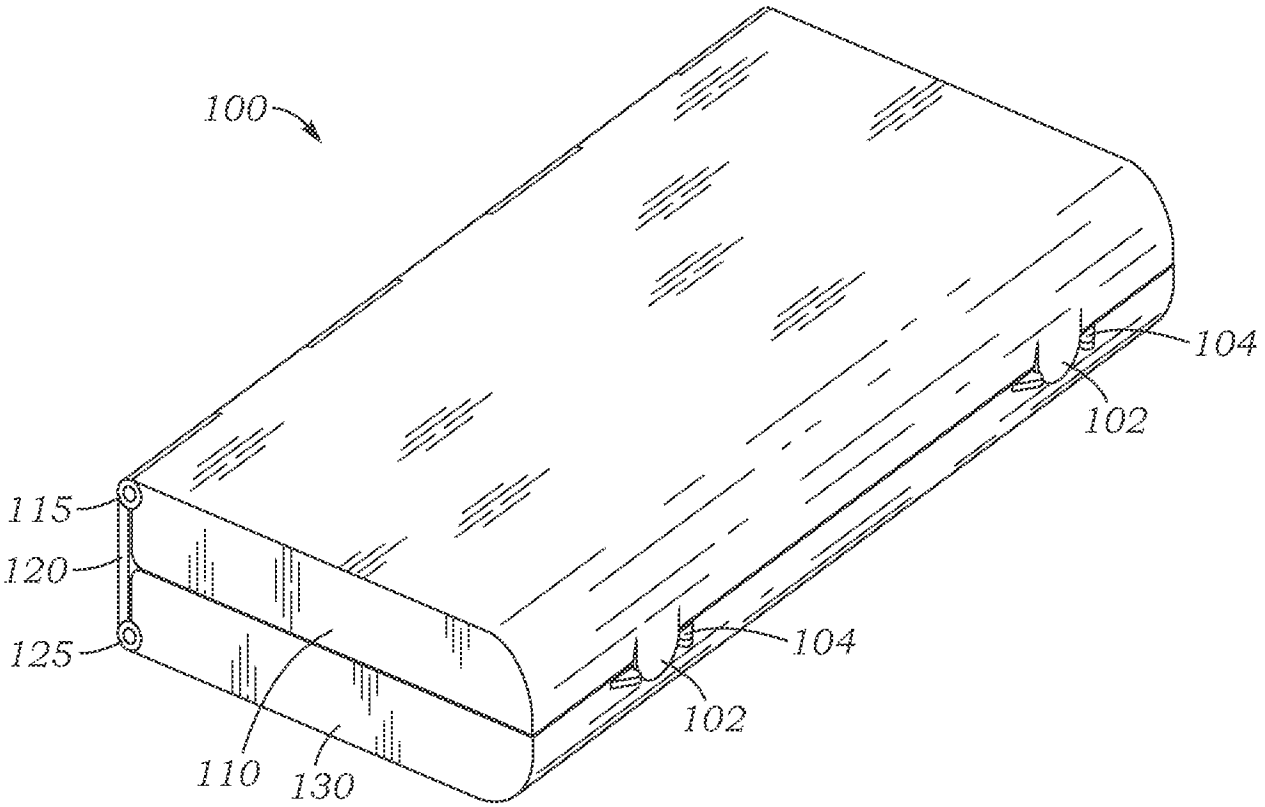
FIG. 4 is a perspective view of the game assembly in a closed configuration for storage or transportation.

FIGS. 2 and 3 depicts the internal or middle game panel 124 being pivotally moved from being disposed on top of the internal case segment 120 to being disposed on top of the lateral game panel 134. The portion of the game area 101 provided on the internal game panel 124 is shown in FIG. 3 as being in facing relation to the game area 101 provided on the lateral game panel 134.

In order to permit the internal game panel 124 to lie substantially flat across the lateral game panel 134, the game panel hinge 129 coupling the internal game panel 124 and the lateral game panel 134 is preferably dimensioned to space apart the facing surfaces at a distance to permit the storage of the game pieces disposed in both internal and lateral game panels 124, 134. In the preferred embodiment depicted in FIG. 1, the game panel hinge 129 extends beyond the surface of lateral game panel 134 at a height to provide the required distance, preferably a height that is equal to the height of two stacked game pieces 10. An optional tab 126 may be provided on the internal game panel 124 on the side of the game area 101 opposing where the internal game panel 124 is hingedly connected to the lateral game panel 134. The tab 126 rests on top of the lateral game panel 134 to maintain the desired distance between the facing internal and lateral game panels 124, 134.

As shown in FIG. 3, once the internal game panel 124 is positioned on top of the lateral game panel 134, the case segments 110, 120 and 130 are freed to fold about hinges 115, 125 towards the closed configuration. Preferably, the game area 101 is disposed on top of the hinges 115, 125 to restrict the pivotal movement of the case segments 110, 120 and 130 when the internal game panel 124 is positioned on top of the internal case segment 120. Additionally, adjacent lateral and internal game panels are preferably in abutting or closely spaced relation when the internal game panel 124 is disposed on the internal case segment 120 so as to provide further restrictions on the pivotal movement of the case segments 110, 120 and 130. In one preferred embodiment, the adjacent lateral and internal game panels are closely spaced apart at a distance of 5 mm or less, preferably 2.5 mm or less, and more preferably 1 mm or less.

FIG. 4 depicts the game assembly 100 in the closed configuration, fully enclosing the game area 101, the game pieces 10 disposed thereon and the in the storage area 136. The internal surfaces of the lateral case segment 110, 130 are in facing relation to one another and the internal case segment 120 is disposed substantially perpendicularly to the lateral case segments 110, 130. In the closed configuration, opposing surfaces of the internal game panel 120 are in spaced facing relation with the lateral game panels 110, 130 and the distance between the internal 124 and lateral game 114, 134 panels permits each of the respective panels to maintain game pieces within corresponding recesses in the closed configuration. This distance is provided both by providing a sufficient width for the internal case segment 120 and also by the height of the game panel hinge 129.

The invention described and claimed herein is not to be limited in scope by the specific preferred embodiments disclosed herein, as these embodiments are intended as illustrations of several aspects of the invention. Indeed, various modifications of the invention in addition to those shown and described herein will become apparent to those skilled in the art from the foregoing description. Such modifications are also intended to fall within the scope of the appended claims.

What is claimed is:

1. A game assembly comprising:

a case comprising a plurality of hinged case segments having an internal surface and an external surface, the case segments configurable between an open configuration exposing a game area with lateral game panels on the internal surface and a closed configuration enclosing the game area, the case segments comprising lateral case segments hingedly coupled to opposing sides of a middle case segment; and a game panel pivotally coupled to one of the lateral game panels and movable about a lengthwise axis of the game panel, wherein the game panel is disposed on top of an internal surface of the middle case segment when the case segments are in the open configuration to expose the game area; and wherein the game panel comprises a plurality of recesses sized and shaped to provide an engaging fit and to secure a plurality of game pieces in intermediate stages of game play for storage when the game panel is disposed on top of the internal surface of one of the lateral case segments and when the case segments are in the closed configuration.

2. The game assembly of claim 1, wherein in the closed configuration, the internal surfaces of the lateral case segments are in facing relation to one another and the middle case segment is disposed substantially perpendicularly to the lateral case segments.

3. The game assembly of claim 2, wherein the lateral case segments each further comprise a side wall extending from at least a portion of a periphery of the lateral case segments, wherein in the closed configuration, the side walls of the lateral case segments abut one another and maintain a distance between the lateral case segments at about a width of the middle case segment.

4. The game assembly of claim 1, wherein in the open configuration, the internal surfaces of the lateral case segments form a contiguous and substantially planar game surface with the game panel when the game panel is disposed on top of the internal surface of the middle case segment.

5. The game assembly of claim 4, further comprising a game panel hinge coupling the game panel with one of the lateral case segments along the lengthwise axis.

6. The game assembly of claim 1, further comprising lateral game panels fixedly disposed on top of the lateral case segments, wherein in the open configuration, the lateral game panels form a contiguous and substantially planar game surface with the game panel when the game panel is disposed on top of the internal surface of the middle case segment.

7. The game assembly of claim 6, further comprising a game panel hinge coupling the game panel with one of the lateral game panels.

8. The game assembly of claim 1, wherein in the closed configuration, opposing surfaces of the game panel and the lateral game panels are in spaced facing relationship and wherein the distance between the opposing surfaces of the game panel and the lateral game panel permits the game panel and lateral game panel to maintain the game pieces within corresponding recesses in the closed configuration.

9. A game assembly comprising:

a case having a plurality of hinged case segments which are foldable from an open configuration exposing a game area to a closed configuration enclosing the game area, the hinged case segments comprising lateral case segments hingedly joined to opposing sides of an internal case segment, the lateral case segments each further comprising a side wall having a height and extending from at least a portion of a periphery of the lateral case segments, wherein in the closed configuration, the side walls of the lateral case segments abut one another and maintain a distance between the lateral case segments at about a width of the internal case segment, and wherein the width of the internal case segment is substantially equal to the combined height of the side walls;

lateral and internal game elements forming at least a portion of the game area, the lateral game elements being disposed on the lateral case segments and the internal game element being hingedly connected to one of the lateral game elements and rotatably moveable between being disposed on the internal case segment and being disposed on the one of the lateral game elements.

10. The game assembly of claim 9 wherein the game area formed by the lateral and internal game elements is a contiguous, planar surface comprising a plurality of recesses adapted to maintain a plurality of game pieces.

11. The game assembly of claim 9, wherein when the internal game element is disposed on the internal case segment, and wherein adjacent lateral and internal game elements either abut one another or are closely spaced apart to prevent the case segments from folding from the open configuration to the closed configuration.

12. The game assembly of claim 9, wherein the internal game element further comprises a tab extending from the internal game surface, the tab displacing the internal game element at a distance from the one of the lateral game elements when the internal game element is folded onto the one of the lateral game elements.

13. The game assembly of claim 9, further comprising a storage cavity adjacent one of the lateral game elements.

14. A game assembly comprising:

a case having a plurality of case segments configurable between an open configuration exposing a game area and a closed configuration enclosing the game area, the case segments comprising lateral case segments with lateral game panels and an internal case segment with an internal game panel, the lateral case segments being pivotally coupled to opposing sides of the internal case segment along a length of the internal case segment;

the game area comprising the lateral game panels and the internal game panel, the lateral game panels being disposed on the lateral case segments and the internal game panel being pivotally movable between being disposed on the internal case segment and being disposed on top of one of the lateral game panels; and a game panel hinge pivotally coupling the internal game panel to the one of the lateral game panels, the game panel hinge being configured to space apart facing surfaces of the internal game panel and the one of the lateral game panels at a distance to permit storage of game pieces secured within the plurality of recesses on the internal game panel when the internal game panel is disposed on top of the one of the lateral game panels and the case segments are in the closed configuration;

wherein when the internal game panel is disposed on the internal case segment, adjacent lateral and internal game panels either abut one another or are closely spaced apart to prevent the case segments from folding from the open configuration to the closed configuration.

15. The game assembly of claim 14, wherein the lateral case segments are pivotally coupled to opposing sides of the internal case segment by hinges and wherein in the open configuration, the game area formed by the lateral and internal game panels is disposed on top of the hinges.

16. The game assembly of claim 14, further comprising a tab extending from the internal game panel to maintain the distance between the internal game panel and the one of the lateral game panels.

17. The game assembly of claim 14, the lateral case segments each further comprise a side wall extending from a periphery of the lateral case segments, the side walls and the internal case segment providing a complete enclosure.

18. The game assembly of claim 14, further comprising a storage compartment disposed within the case.

19. The game assembly of claim 1, wherein the game panel is hingedly coupled to a lateral game panel along its lengthwise axis and wherein when the game panel is pivotally moved on top of the lateral game panel, the opposing surfaces of the game panel and the lateral game panel are in spaced facing relationship to permit the storage of game pieces on both the game panel and the lateral game panel.

* * * * *